United States Patent [19]

Remstad et al.

[11] Patent Number: 4,886,417

[45] Date of Patent: Dec. 12, 1989

[54] FUEL PUMP AND RADIAL-FLOW IMPELLER THEREFOR

[75] Inventors: Steven C. Remstad, Rockford; John M. Kassel, Roscoe, both of Ill.

[73] Assignee: Sundstrand Corporation, Rockford, Ill.

[21] Appl. No.: 280,715

[22] Filed: Dec. 6, 1988

[51] Int. Cl.[4] ..... F04D 29/24

[52] U.S. Cl. ..... 415/208.3; 416/185

[58] Field of Search ..... 415/206, 210, 211, 219 C; 416/182, 183, 185, 186 R, 186 A, 188

[56] References Cited

U.S. PATENT DOCUMENTS

| | | | |
|---|---|---|---|
| 1,111,250 | 9/1914 | Davidson | 415/208.1 |
| 1,326,043 | 12/1919 | Flugel | 416/185 |
| 1,809,526 | 6/1931 | Namur | 416/186 |
| 2,927,536 | 3/1960 | Rhoades | 415/48 |
| 3,797,085 | 3/1974 | Aartman | 29/156.8 R |
| 3,824,029 | 7/1974 | Fabri et al. | 415/206 |
| 3,832,089 | 8/1974 | Moellmann | 415/207 |
| 4,395,130 | 7/1983 | Kutowy | 417/250 |
| 4,425,081 | 1/1984 | Raczynski | 415/211 |
| 4,752,187 | 6/1988 | Hergt et al. | 416/186 R |

FOREIGN PATENT DOCUMENTS

| | | | |
|---|---|---|---|
| 140542 | 12/1948 | Australia . | |
| 554071 | 7/1932 | Fed. Rep. of Germany . | |
| 58-211599 | 12/1983 | Japan | 415/206 |
| 269886 | 11/1950 | Switzerland . | |

*Primary Examiner*—Robert E. Garrett
*Assistant Examiner*—John T. Kwon
*Attorney, Agent, or Firm*—Antonelli, Terry & Wands

[57] ABSTRACT

A single stage centrifugal fuel pump which can provide a large range of flow, 1 to 300 gpm, while maintaining low flow, high speed operation with pressure instability at minimum values comprises a radial-flow impeller having a front shroud and a discharge for discharging fuel from the impeller. A diffuser ring has a throat entrance located opposite and in spaced relation to the discharge of the impeller. The front shroud is provided with an extension which extends into the vaneless space between the impeller discharge and the throat entrance of the diffuser ring thereby reducing the flow at which pressure instability inception occurs.

11 Claims, 1 Drawing Sheet

FUEL PUMP AND RADIAL-FLOW IMPELLER THEREFOR

TECHNICAL FIELD

The present invention is directed to a fuel pump, particularly a single stage centrifugal fuel pump, and a radial-flow impeller therefor, which can provide a large range of flow while maintaining low flow, high speed operation with pressure instability at minimum values.

BACKGROUND ART

A problem with conventional centrifugal fuel pump design is that the mechanisms used in the pump design to achieve minimum temperature rise at low flow, high speed operation yield a positive sloping pressure rise characteristic when pump pressure rise (ordinate) is plotted against pump flow (abscissa). This positive sloping pressure rise characteristic typically yields unstable pressure operation in the centrifugal pumps when operating at the low flow, high speed conditions.

DISCLOSURE OF INVENTION

An object of the present invention is to provide an improved centrifugal fuel pump which overcomes the aforementioned problem with conventional pumps. In particular, an object of the invention is to provide an improved centrifugal fuel pump which solves the problem of low flow, high speed pressure instability. More specifically, an object of the invention is to provide an improved centrifugal fuel pump and a radial-flow impeller therefor which reduce the flow at which pressure instability inception occurs.

These and other objects of the invention are attained by the improved fuel pump of the invention which comprises a radial-flow impeller having a front shroud and discharge means for discharging fuel from the impeller. A diffuser ring of the pump with a throat entrance is located opposite and in spaced relation to the discharge means of the impeller. The front shroud of the impeller is formed with an extension which extends into the space between the impeller discharge means and the throat entrance of the diffuser ring thereby reducing the flow at which pressure instability inception occurs.

The fuel pump of the disclosed embodiment is particularly advantageous in that it can provide a large range of flow, 1 to 300 gpm, while maintaining low flow, high speed operation with pump temperature rise and pressure instability at minimum values. The fuel pump of the illustrated embodiment is a single stage centrifugal pump. The front shroud extension preferably extends across most of the space between the discharge means of the impeller and the throat entrance of the diffuser ring although this extension may be lesser or greater depending upon operating requirements.

These and other objects, features and advantages of the present invention will become more apparent from the following description when taken in connection with the accompanying drawings, which show, for purposes of illustration only, one preferred embodiment in accordance with the present invention.

BEST MODE FOR CARRYING OUT THE INVENTION

Figure 2:
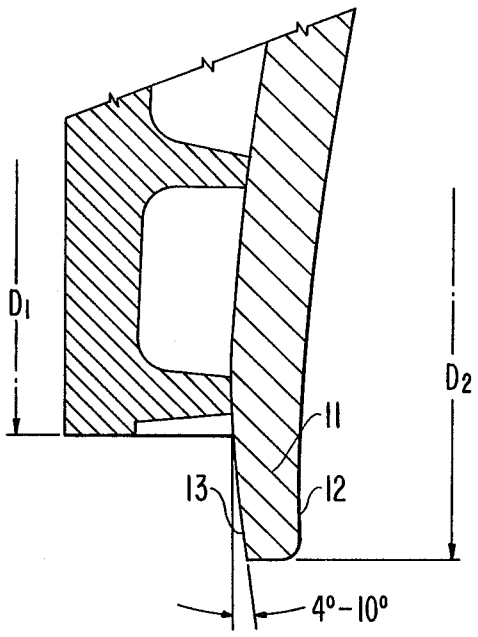
FIG. 2 is an enlarged, cross-sectional view of a portion of the impeller of the pump of FIG. 2 showing the extension of the front shroud of the impeller.

Referring now to the drawings, a single stage, centrifugal fuel pump 1 according to the invention comprises a radial flow type, single stage impeller 2 adapted to be rotated about its center axis A—A within a stationary diffuser ring 3 of the pump. The impeller 2 is formed with a plurality of vanes 4 thereon which, together with a front shroud 5 of the impeller, define a plurality of ways 6 for the flow of liquid from a pump inlet 7 to an impeller discharge 8 during rotation of the impeller.

The discharge 8 of the impeller is separated from a throat entrance 9 of the diffuser ring by a vaneless space 10. According to the invention, the front shroud 5 of the impeller includes an extension 11 which extends into the vaneless space 10. It has been found that incorporation of the extended shroud in the fuel pump 1 reduces the flow at which pressure instability inception occurs.

As shown in FIG. 2, the extension 11 of the front shroud 5 has a front surface 12 which is a continuation of the curvature of the front shroud 5 and a linear rear surface 13 which makes an angle of betweem 4° and 10° and preferably 6° to 8°, away from the continuation of the curvature of the shroud 5 and the path of the liquid therealong discharged from discharge 8. If the rear surface 13 did not taper in this manner, there would be an undesirable region of high pressure in the space 10 due to the velocity drop of the liquid in space 10 after being discharged from discharge 8. The increase in pressure can reduce the efficiency of the pump. By tapering the surface 13 away from the liquid flow at least 4°, diffusion takes place to reduce the increase in pressure. If the taper is more than 10° too much diffusion takes place which can result in a flow separation.

Figure 1:
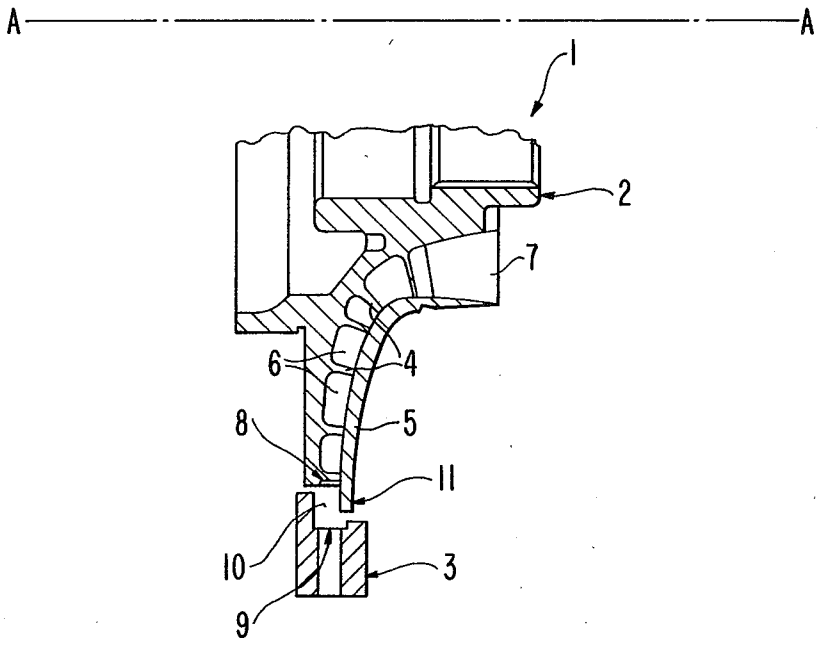
FIG. 1 is a cross-sectional view of a portion of a centrifugal fuel pump according to the invention taken along the longitudinal axis of rotation A—A of the pump.

In the disclosed embodiment, the impeller 2 has a diameter $D_1$ at the discharge 8 and a diameter $D_2$ at the outer end of the extension 11 of the shroud 5 with the ratio of diameters $D_2/D_1$ being about 1.1. This results in the extension 11 extending across most of the vaneless space 10, in particular, across about $\frac{3}{4}$ of the vaneless space 10 as shown in FIG. 1. With this arrangement, the centrifugal fuel pump 1 can provide a large range of flow, 1 to 300 gpm, while maintaining low flow, high speed operation with pump temperature rise and pressure instability at minimum values. As an example, the impeller of the pump can be driven in a conventional manner up to 30,000 rpm for pumping fuel. The pressure rise across the impeller in the pump is a function of speed and flow and it ranges from 50 psid to 1800 psid in the disclosed embodiment. The maximum pressure is attained at an intermediate operating flow and maximum operating speed of the pump which roughly corresponds to and is a function of the pump efficiency.

While we have shown and described only one embodiment in accordance with the present invention, it is understood that the same is not limited thereto, but is susceptible to numerous changes and modifications as known to those skilled in the art. Therefore, we do not wish to be limited to the details shown and described herein, but intend to cover all such changes and modifications as are encompassed by the scope of the appended claims.

I claim:

1. A fuel pump comprising a radial-flow impeller having a front shroud and discharge means for discharging fuel from the impeller, a diffuser ring with a throat entrance located opposite and in spaced relation to the discharge means of the impeller, and wherein the front shroud of the impeller has an extension which extends into the space between the impeller discharge means and the throat entrance of the diffuser ring and wherein a surface of the extension which is adjacent the liquid discharged from the impeller discharge means tapers away from the path of the liquid at an angle of between 4 degrees and 10 degrees to diffuse a pressure rise of the liquid being discharged from the impeller discharge means.

2. The fuel pump according to claim 1, wherein said pump can pump over a range of 1 to 300 gpm.

3. The fuel pump according to claim 1, wherein said fuel pump is a single stage centrifugal pump.

4. The fuel pump according to claim 1, wherein said front shroud extension extends across most of the space between the discharge means of the impeller and the throat entrance of the diffuser ring.

5. The fuel pump according to claim 4, wherein said front shroud extension extends across about $\frac{3}{4}$ the space between the discharge means of the impeller and the throat entrance of the diffuser ring.

6. The fuel pump according to claim the surface of the extension tapers at angle 6° and 8° away from the liquid path.

7. A centrifugal pump comprising a radial-flow impeller having a front shroud and discharge means for discharging fuel from the impeller, a diffuser ring with a throat entrance located opposite and in spaced relation to the discharge means of the impeller, and wherein the front shroud of the impeller has an extension which extends into the space between the impeller discharge means and the throat entrance of the diffuser ring and wherein a surface of the extension which is adjacent the liquid discharged from the impeller discharge means tapers away from the path of the liquid at an angle of between 4 degrees and 10 degrees to diffuse a pressure rise of the liquid being discharged from the impeller discharge means.

8. The centrifugal pump according to claim 7, wherein said pump can pump fuel over a range of 1 to 300 gpm.

9. The centrifugal pump according to claim 7, wherein said centrifugal pump is a single stage pump.

10. The centrifugal pump according to claim 7, wherein said front shroud extension extends across most of the space between the discharge means of the impeller and the throat entrance of the diffuser ring.

11. The centrifugal pump according to claim 10, wherein said front shroud extension extends across about $\frac{3}{4}$ the space between the discharge means of the impeller and the throat entrance of the diffuser ring.

* * * * *